US009409287B2

(12) United States Patent
Broadaway et al.

(10) Patent No.: US 9,409,287 B2
(45) Date of Patent: Aug. 9, 2016

(54) HEX WRENCH TOOL HANDLE

(71) Applicant: Apex Brands, Inc., Sparks, MD (US)

(72) Inventors: Eric D. Broadaway, New Freedom, PA (US); Ian L. Gresham, Baltimore, MD (US); Zhihong Fu, Shanghai (CN)

(73) Assignee: Apex Brands, Inc., Sparks, MD (US)

( * ) Notice: Subject to any disclaimer, the term of this patent is extended or adjusted under 35 U.S.C. 154(b) by 231 days.

(21) Appl. No.: 13/954,569

(22) Filed: Jul. 30, 2013

(65) Prior Publication Data

US 2014/0026724 A1 Jan. 30, 2014

Related U.S. Application Data

(60) Provisional application No. 61/677,163, filed on Jul. 30, 2012.

(51) Int. Cl.
*B25G 1/00* (2006.01)
*B25G 1/06* (2006.01)

(52) U.S. Cl.
CPC . *B25G 1/00* (2013.01); *B25G 1/063* (2013.01)

(58) Field of Classification Search
CPC ..... B25G 1/005; B25G 1/063; B25B 15/008; B25B 15/02; B25B 23/0007; B25B 23/16
USPC ..... 81/489, 177.1, 487, 436–439
See application file for complete search history.

(56) References Cited

U.S. PATENT DOCUMENTS

| | | | | |
|---|---|---|---|---|
| 1,172,656 | A | 2/1916 | Yorgensen | |
| 2,465,619 | A * | 3/1949 | Veit | 81/177.1 |
| 2,530,914 | A * | 11/1950 | Simmons | 81/489 |
| 2,569,069 | A | 9/1951 | Motel | |
| 4,566,357 | A * | 1/1986 | Carossino | 81/436 |
| 5,765,454 | A * | 6/1998 | Barbulescu et al. | 81/177.1 |
| 6,510,766 | B1 * | 1/2003 | Lin | 81/439 |
| 7,946,203 | B2 | 5/2011 | Johnson et al. | |
| 2011/0162490 | A1 | 7/2011 | Chang | |

* cited by examiner

*Primary Examiner* — Hadi Shakeri
(74) *Attorney, Agent, or Firm* — Nelson Mullins Riley & Scarborough, LLP

(57) ABSTRACT

A tool handle for releasably receiving a tool including a core portion having a base portion and a cylindrical shaft portion extending outwardly therefrom, the base portion including a first surface, a second surface, and an outer wall extending therebetween, the outer wall defining a first bore therein, and a grip portion rotatably disposed about the shaft portion of the core. The first bore is configured to releasably receive a first portion of the tool.

7 Claims, 2 Drawing Sheets

HEX WRENCH TOOL HANDLE

CLAIM OF PRIORITY

This application claims priority to U.S. Provisional Patent Application No. 61/677,163 filed Jul. 30, 2012, the entire disclosure which is incorporated herein.

FIELD OF THE INVENTION

The present invention relates generally to hand tools. More particularly, the present invention relates to a tool handle to facilitate performing tasks with hex wrenches.

SUMMARY OF THE INVENTION

One embodiment of the present invention provides a tool handle for releasably receiving a tool including a core portion having a base portion and a cylindrical shaft portion extending outwardly therefrom, the base portion including a first surface, a second surface, and an outer wall extending therebetween, the outer wall defining a first bore therein, and a grip portion rotatably disposed about the shaft portion of the core. The first bore is configured to releasably receive a first portion of the tool.

The accompanying drawings, which are incorporated in and constitute a part of this specification, illustrate one or more embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended drawings, in which.

Figure 1A:
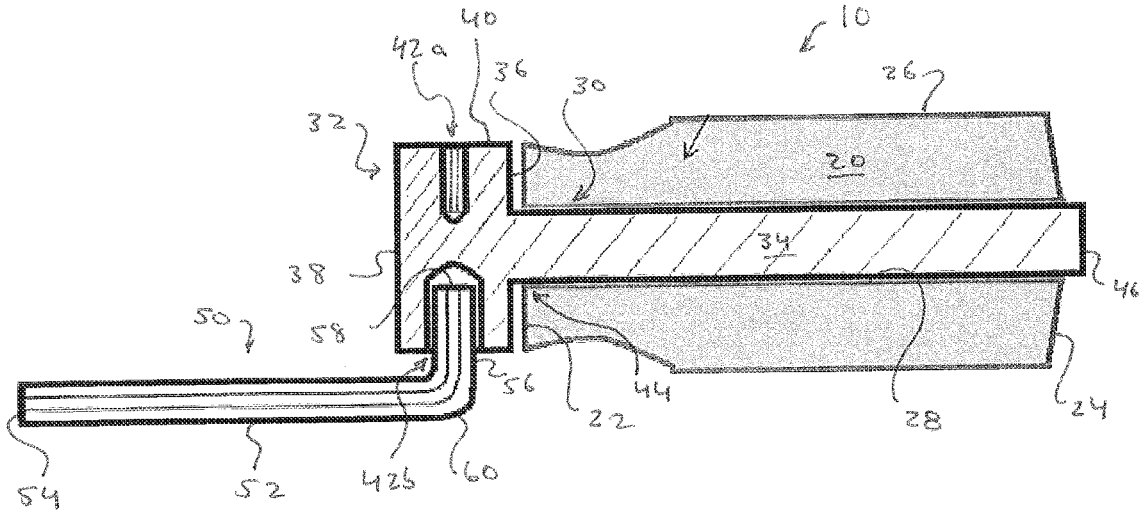
FIGS. 1A and 1B are cross-sectional views of a tool handle for use with a hex wrench in accordance with an embodiment of the present disclosure.

Repeat use of reference characters in the present specification and drawings is intended to represent same or analogous features or elements of the invention according to the disclosure.

DETAILED DESCRIPTION OF THE PREFERRED EMBODIMENTS

Reference will now be made in detail to presently preferred embodiments of the invention, one or more examples of which are illustrated in the accompanying drawings. Each example is provided by way of explanation, not limitation, of the invention. In fact, it will be apparent to those skilled in the art that modifications and variations can be made in the present invention without departing from the scope and spirit thereof. For instance, features illustrated or described as part of one embodiment may be used on another embodiment to yield a still further embodiment. Thus, it is intended that the present invention covers such modifications and variations as come within the scope of the appended claims and their equivalents.

Figure 2A:
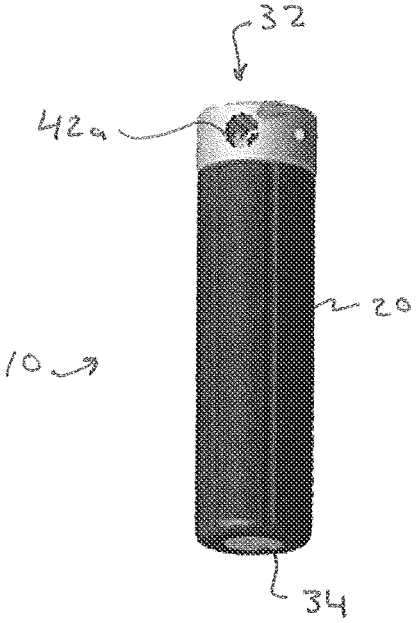
FIGS. 2A, 2B and 2C are perspective views of the tool handle as shown in FIGS. 1A and 1B.
Figure 2B:
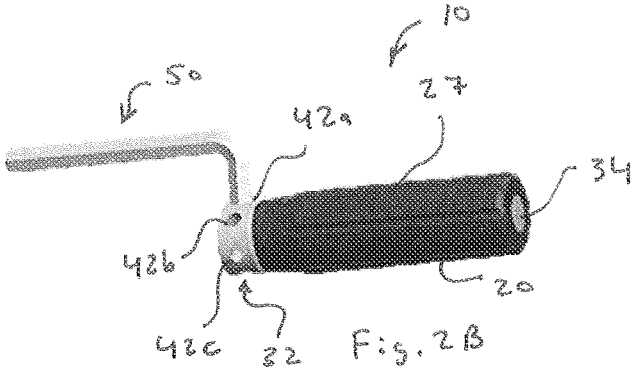
Figure 2C:
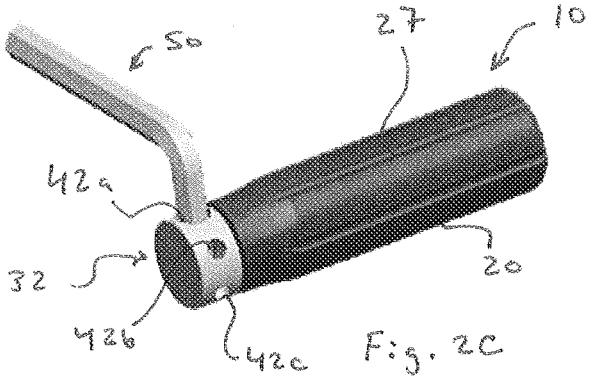

A tool handle 10 in accordance with the present disclosure is shown. Tool handle 10 includes a grip portion 20 that is rotatably mounted to a core portion 30. Grip portion 20 includes a proximal end 22, a distal end 24 and a cylindrical outer surface 26 extending therebetween. As best seen in FIGS. 2A through 2C, cylindrical outer surface 26 preferably includes a plurality of longitudinal grooves 27 to facilitate grasping tool handle 10. Additionally, grip portion 20 defines a cylindrical bore 28 that extends from proximal end 22 to distal end 24, cylindrical bore 28 being configured to rotatably receive a portion of core portion 30, as discussed in greater detail below. In the embodiment shown, grip portion 20 is preferably constructed of a hard plastic material. Note, however, inlays of elastomeric materials may be secured to outer surface 26 of grip portion 20 to further enhance a user's grasp. As well, the entire grip portion 20 may be constructed of an elastomeric material provided that cylindrical bore 28 is lined with a low friction material to allow grip portion 20 to rotate relative to core portion 30, as discussed in greater detail below. Note, alternate embodiments of grip portion 20 may be of numerous other cross-sectional shapes, i.e., hexagonal, triangular, square, etc.

Figure 1B:
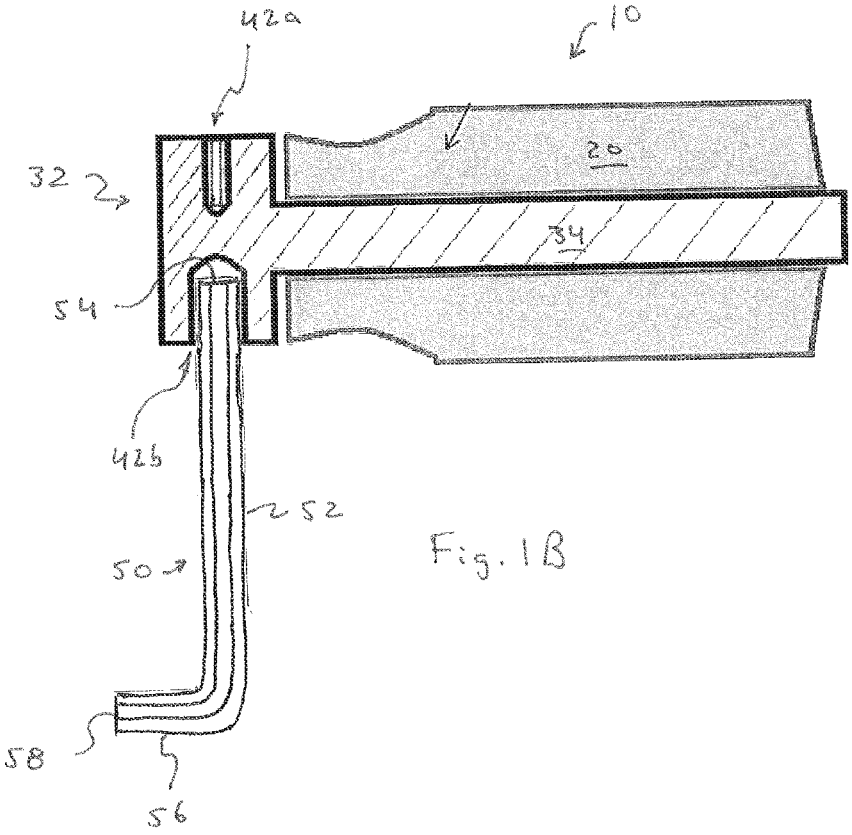

As best seen in FIGS. 1A and 1B, core portion 30 includes a base 32 and a shaft 34 extending outwardly therefrom. Base 32 includes a first surface 36, a second surface 38 and a cylindrical outer wall 40 extending therebetween. Cylindrical outer wall 40 defines a plurality of blind bores 42*a*, 42*b*, etc., that are configured to slidably receive one of a first end 54 or a second end 58 of a hex wrench 50. As shown, the cross-section of each blind bore forms a dodecahedron such that a correspondingly sized hex wrench 50 can be received in any one of 12 angular positions with respect to the longitudinal center axis of the blind bore. Note, however, that in alternate embodiments, the blind bores are hexagonally shaped. Shaft 34 extends outwardly from, and is perpendicular to, first surface 36 of base 32. Shaft 34 includes a cylindrical outer surface 48 that extends between its proximal end 44 and its distal end 46, and is correspondingly shaped to cylindrical bore 28 of grip portion 20 so that it can be rotatably secured therein.

As shown in FIG. 1A, second end 58 of hex wrench 50 is slidably received in blind bore 42*b* of base 32 such that a first elongated portion 52 of hex wrench 50 is parallel to the longitudinal center axis of tool handle 10. As such, a fastener (not shown) can be engaged by first end 54 of hex wrench 50, and the fastener may be either tightened or loosened simply by rotating tool handle, and therefore hex wrench 50, about the longitudinal center axis of first elongated portion 52 of hex wrench 50. As best seen in FIG. 1B, when a greater amount of torque is desired, first end 54 of first elongated portion 52 is slidably received in blind bore 42*b* such that tool handle 10, and therefore hex wrench 50, is rotatable about the longitudinal center axis of second elongated portion 56. This configuration allows a greater amount of torque to be applied to the fastener although the same amount of force is applied to the tool handle since the moment arm created by first elongated portion 52 of hex wrench 50 is greater than that created by the shorter second elongated portion 56.

While one or more preferred embodiments of the invention are described above, it should be appreciated by those skilled in the art that various modifications and variations can be made in the present invention without departing from the scope and spirit thereof. It is intended that the present invention cover such modifications and variations as come within the scope and spirit of the appended claims and their equivalents.

What is claimed is:

1. A tool handle for releasably receiving a plurality of tools, comprising:

a core portion having a base portion and a cylindrical shaft portion extending outwardly therefrom, the base portion including a first surface, a second surface, and an outer wall extending therebetween, the outer wall defining a first aperture and a second aperture therein, the first aperture and the second aperture being configured to releasably receive a first portion of a corresponding tool of the plurality of tools, the cylindrical shaft including a proximal end integrally formed with the first surface of the base portion, a distal end, and an outer surface extending therebetween; and a grip portion rotatably disposed about the shaft portion of the core, the grip portion including a proximal end, a distal end, and a cylindrical bore extending therebetween, the entirety of the cylindrical bore rotatably receiving the cylindrical shaft, wherein the second aperture has a maximum dimension that is perpendicular to its longitudinal center axis and is greater than a maximum dimension of the first aperture that is perpendicular to its longitudinal center axis.

2. The tool handle of claim 1, wherein the first aperture and the second aperture are blind bores.

3. The tool handle of claim 1, wherein the cross-sections of the first aperture and the second aperture are hexagonal.

4. The tool handle of claim 1, wherein the longitudinal center axes of the first aperture and the second aperture are not parallel.

5. The tool handle of claim 1, further comprising a third aperture defined in the outer wall of the base portion, wherein a longitudinal center axis of the third aperture intersects the longitudinal center axes of the first aperture and the second aperture.

6. The tool handle of claim 1, wherein the longitudinal center axis of the first aperture and the longitudinal center axis of the second aperture are collinear.

7. The tool handle of claim 6, wherein the first aperture and the second aperture further comprise blind bores.

* * * * *